US006808031B2

(12) United States Patent
Mensa-Wilmot et al.

(10) Patent No.: US 6,808,031 B2
(45) Date of Patent: Oct. 26, 2004

(54) DRILL BIT HAVING LARGE DIAMETER PDC CUTTERS

(75) Inventors: Graham Mensa-Wilmot, Houston, TX (US); David K. Truax, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/827,131

(22) Filed: Apr. 5, 2001

(65) Prior Publication Data

US 2002/0144843 A1 Oct. 10, 2002

(51) Int. Cl.[7] ..... E21B 10/36
(52) U.S. Cl. ..... 175/434; 175/374
(58) Field of Search ..... 175/434, 426, 175/374

(56) References Cited

U.S. PATENT DOCUMENTS

| | | | | |
|---|---|---|---|---|
| 4,852,671 A | | 8/1989 | Southland | 175/329 |
| 4,913,244 A | | 4/1990 | Trujillo | 175/65 |
| 4,984,642 A | | 1/1991 | Renard et al. | 175/329 |
| 5,186,268 A | | 2/1993 | Clegg | 175/399 |
| 5,383,527 A | | 1/1995 | Azar | 175/431 |
| 5,494,477 A | | 2/1996 | Flood et al. | 451/540 |
| 5,566,779 A | * | 10/1996 | Dennis | 175/426 |
| 5,662,720 A | | 9/1997 | O'Tighearnaigh | 51/295 |
| 5,924,501 A | * | 7/1999 | Tibbitts | 175/429 |
| 5,992,548 A | | 11/1999 | Silva et al. | 175/391 |
| 6,202,770 B1 | | 3/2001 | Jurewicz et al. | 175/428 |
| 6,220,375 B1 | * | 4/2001 | Butcher et al. | 175/428 |
| 6,302,223 B1 | * | 10/2001 | Sinor | 49/248 |

FOREIGN PATENT DOCUMENTS

| | | | |
|---|---|---|---|
| EP | 0 358 526 A2 | 3/1990 | B24D/17/00 |
| EP | 0 460 306 A1 | 12/1991 | C01B/31/06 |
| EP | 0 841 463 A2 | 5/1998 | E21B/10/56 |
| EP | 0 976 444 A2 | 2/2000 | B01J/3/06 |
| EP | 0 976 444 A3 | 10/2000 | B01J/3/06 |
| EP | 1 188 898 A2 | 3/2002 | E21B/10/56 |
| EP | 1 188 898 A3 | 5/2002 | E21B/10/56 |
| WO | WO 92 14906 A | 9/1992 | E21B/10/56 |

* cited by examiner

*Primary Examiner*—Thomas B. Will
*Assistant Examiner*—Meredith Petravick
(74) *Attorney, Agent, or Firm*—Osha & May L.L.P.

(57) ABSTRACT

A variety of large diameter PDC cutters for use in drill bits are disclosed. Specifically, various PDC cutters having a diameter between 19.0 mm and 25.0 mm are disclosed. The various PDC cutters disclosed include an elliptical PDC cutter, wherein a major diameter of the elliptical cutter is selected from a range of 19.0 mm to 25.0 mm, a circular PDC cutter, wherein a diameter of the circular cutter falls between 19.0 mm and 25.0 mm, and a non-planar substrate cutter, wherein a diameter of the non-planar cutter falls between 19.0 mm and 25.0 mm. Additionally, the thickness of the diamond table is increased as compared to prior art PDC cutters. The increase in diamond table thickness results in improved durability and performance.

23 Claims, 6 Drawing Sheets

PRIOR ART

DRILL BIT HAVING LARGE DIAMETER PDC CUTTERS

BACKGROUND OF THE INVENTION

1. Field of the Invention

The invention relates generally to drill bits which have polycrystalline diamond compact ("PDC") cutters thereon. More particularly, the invention relates to drill bits having a particular diameter of PDC cutters.

2. Background Art

Polycrystalline diamond compact ("PDC") cutters have been used in industrial applications including rock drilling and metal machining for many years. In these applications, a compact of polycrystalline diamond (or other superhard material such as cubic boron nitride) is bonded to a substrate material, which is typically a sintered metal-carbide to form a cutting structure. A compact is a polycrystalline mass of diamonds (typically synthetic) that are bonded together to form an integral, tough, high-strength mass.

An example of a rock bit for earth formation drilling using PDC cutters is disclosed in U.S. Pat. No. 5,186,268. FIGS. 1 and 2 from that patent show a rotary drill bit having a bit body 10. The lower face of the bit body 10 is formed with a plurality of blades 17–25, which extend generally outwardly away from a central longitudinal axis of rotation 15 of the drill bit. A plurality of PDC cutters 26 are disposed side by side along the length of each blade. The number of PDC cutters 26 carried by each blade may vary. The PDC cutters 26 are brazed to a stud-like carrier, which may also be formed from tungsten carbide, and is received and secured within a socket in the respective blade.

One of the major factors in determining the longevity of PDC cutters is the strength of the bond between the polycrystalline diamond layer and the sintered metal carbide substrate. For example, analyses of the failure mode for drill bits used for earth formation drilling show that in approximately one-third of the cases, bit failure or wear is caused by delamination of the diamond from the metal carbide surface. It has been previously noted that as the diameter of the PDC cutters increase, the stress on the PDC layer and the metal carbide substrate increases. Because of this, prior art bits have typically been limited to having cutters of diameters of 19 mm. PDC cutters having an cutter diameter of 25 mm or 50 mm have been attempted, but are subject to high failure rates because of the increase in shear stress accompanying the larger cutter diameter.

A PDC cutter may be formed by placing a cemented carbide substrate into the container of a press. A mixture of diamond grains or diamond grains and catalyst binder is placed atop the substrate and compressed under high pressure, high temperature conditions. In so doing, metal binder migrates from the substrate and passes through the diamond grains to promote a sintering of the diamond grains. As a result, the diamond grains become bonded to each other to form the diamond layer, and the diamond layer is subsequently bonded to the substrate, which is typically a planar surface. The substrate is often a metalcarbide composite material, such as tungsten carbide.

The deposited diamond layer is often referred to as the "diamond table," or "abrasive layer." Correspondingly, the "diamond table thickness" is defined as the thickness (by industry practice usually measured in inches) of the diamond table on the substrate. Furthermore, the "exposure" (by industry practice usually measured in millimeters ("mm")) is defined as the portion of the diameter of the cutter which extends past the blade in the direction that the bit drills. Typically, diamond table thickness is limited by the stresses on the diamond table at the interface between the diamond and the substrate. Too thick of a diamond table may result in stress that can cause the cutter to shear from the bit body, or may result in brittle failure of the diamond table. Typical prior art diamond table thicknesses range from 0.090 inches to 0.120 inches. Typical prior art exposures are less than 10.0 mm.

As stated above, many prior art PDC cutters have the diamond table bonded to a substrate having a planar layer. However, in an attempt to reduce the inherent stresses present at the PDC/metal carbide interface, several prior art systems have incorporated substrates having a non-planar geometry to form a non-planar interface. U.S. Pat. No. 5,494,477 discloses such a non-planar interface. FIG. 3 illustrates one embodiment of a non-planar interface. In use, as PDC cutter 110 wears, wear plane 16 (which represents the surface providing cutting action) slowly progresses towards the center of the PDC cutter 110.

A second system using a non-planar interface is disclosed in U.S. Pat. No. 5,662,720. In this system, the surface topography of the substrate system is altered to create an "egg-carton" appearance. This is shown in FIG. 4. The use of an "egg-carton" shape allows the stress associated with the cutting to be distributed over a larger surface area, thereby reducing delamination of the diamond table from the substrate.

As stated above, the most significant problem with PDC cutters arises from the creation of internal stresses within the diamond layer itself, which can result in a fracturing of the layer. The stresses result from difference in thermal properties of the diamond and the substrate, and are distributed according to the size, geometry and physical properties of the substrate and the PDC layer. As previously explained, PDC cutter diameters have been limited to 19 mm to obviate this stress problem when used in rotary drill bits.

Summary of Invention

In one aspect, the invention includes a drill bit having a bit body including at least one blade thereon, and at least one polycrystalline diamond compact cutting element disposed on the blade. The polycrystalline diamond compact cutting element has a diameter between 19.0 mm and 25.0 mm.

In one aspect, the invention includes a drill bit having a bit body including at least one blade thereon, and at least one polycrystalline diamond compact cutting element disposed on the blade, wherein the polycrystalline diamond compact cutting element has a non-planar interface between a substrate and a diamond layer, and the polycrystalline diamond compact cutting element has a diameter between 19.0 mm and 25.0 mm.

In one aspect, the invention includes a drill bit having a bit body including at least one blade thereon, and at least one polycrystalline diamond compact cutting element disposed on the blade, wherein the polycrystalline diamond compact cutting element has an elliptical shape, and the polycrystalline diamond compact cutting element has a major axis diameter between 19.0 mm and 25.0 mm.

In one aspect, the invention includes a drill bit having a bit body including at least one blade thereon, and at least one polycrystalline diamond compact cutting element disposed on the blade. The cutting element has a non planar interface between a substrate and a diamond table thereof, and has a diameter greater than 19.0 mm.

In one aspect, the invention includes a drill bit having a bit body including at least one blade thereon, and at least one polycrystalline diamond compact cutting element disposed on the blade. The polycrystalline diamond compact cutting element has a diamond layer with a thickness greater than 0.140 inches. In some embodiments, the diamond table thickness is between 0.14 and 0.20 inches. The polycrystalline diamond compact cutting element in some embodiments has a diameter between 19.0 mm and 25.0 mm.

Other aspects and advantages of the invention will be apparent from the following description and the appended claims.

DETAILED DESCRIPTION

Figure 1:
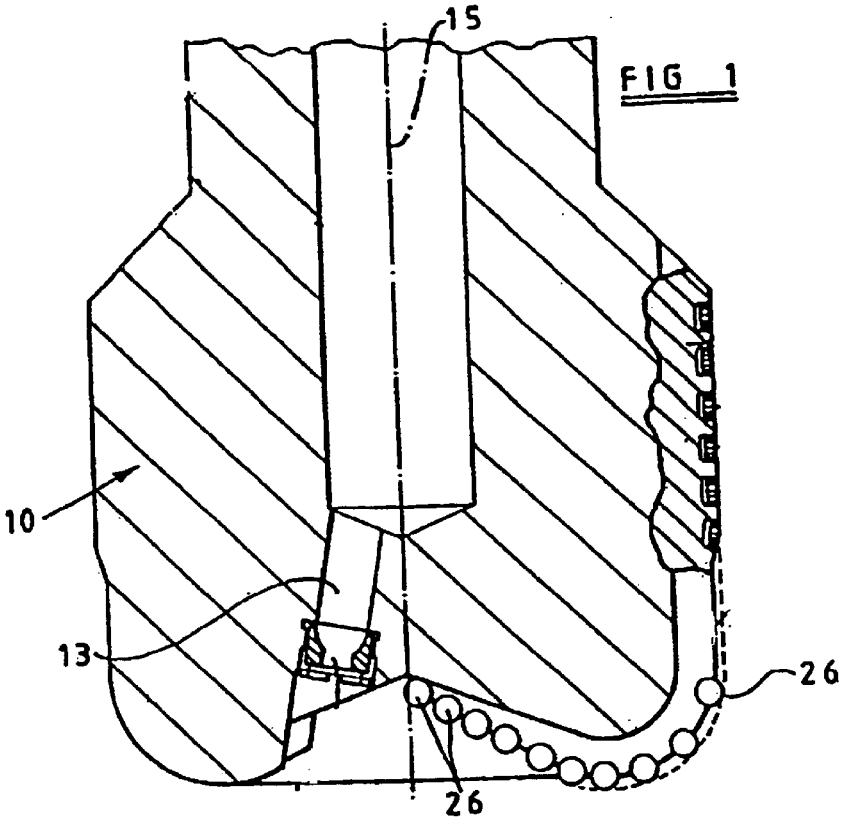
FIG. 1 is an illustration of a prior art drill bit having PDC cutters.
Figure 2:
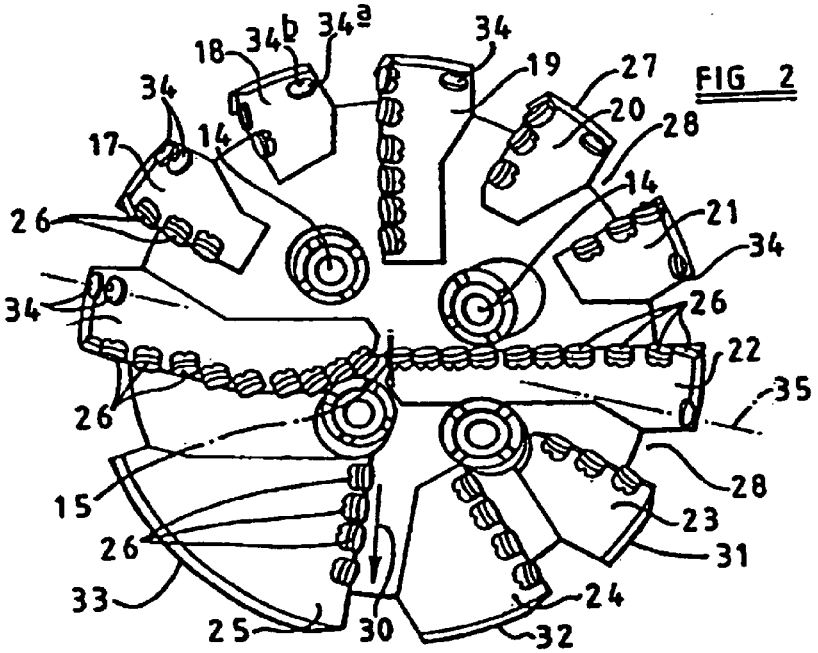
FIG 2 PRIOR ART
FIG. 2 is an illustration of a prior art drill bit having PDC cutters.
Figure 3:
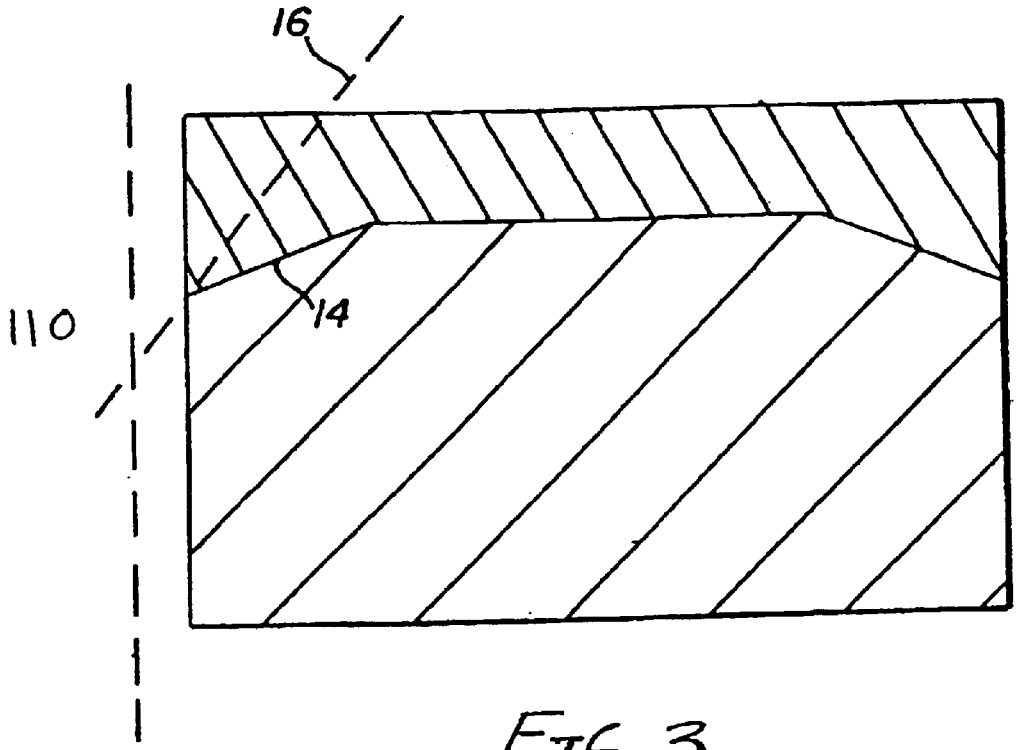
FIG. 3 PRIOR ART
FIG. 3 illustrates a cross-sectional view of a prior art PDC cutter having a non-planar interface.
Figure 4:
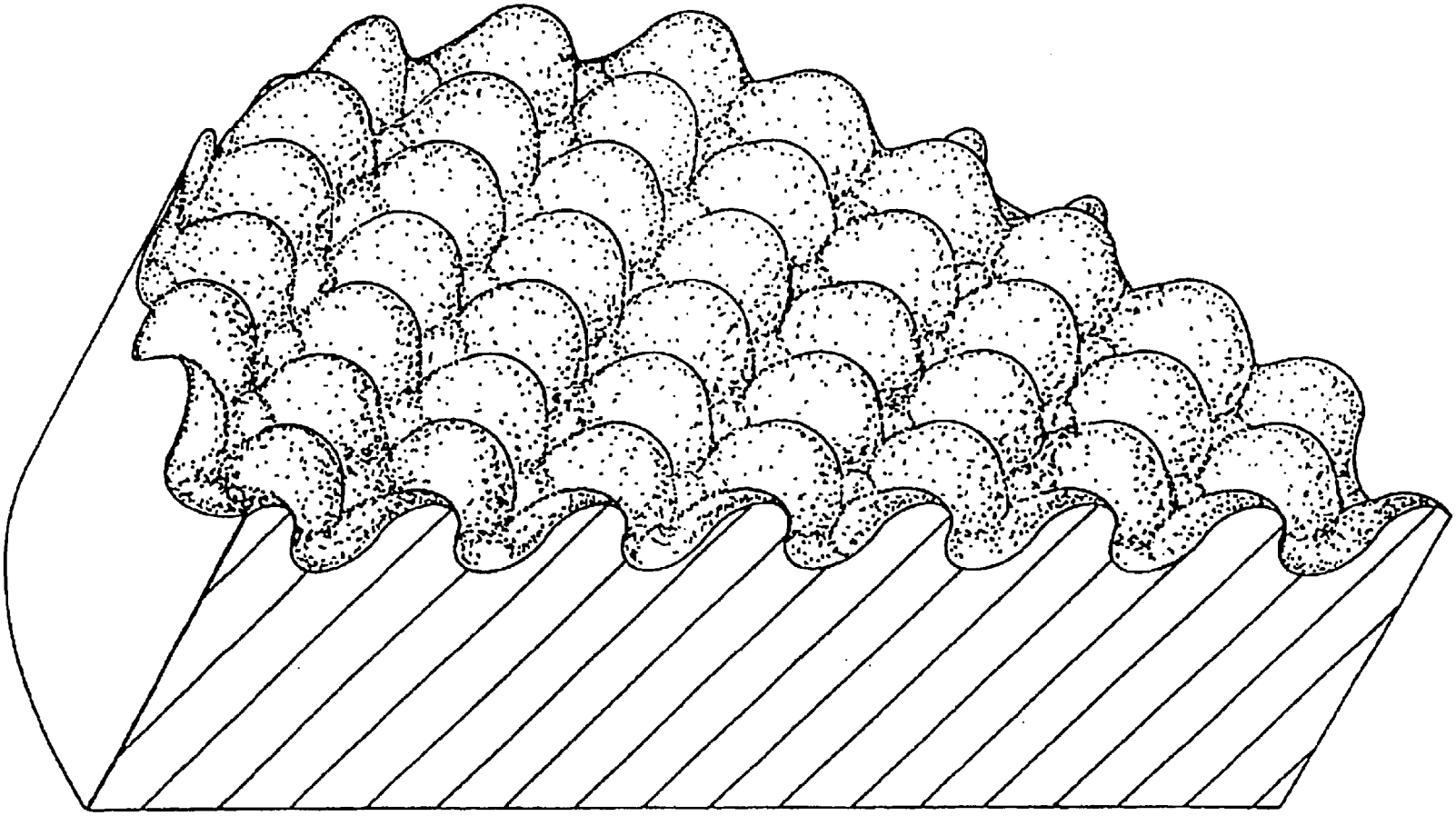
FIG. 4 PRIOR ART
FIG. 4 illustrates a prior art non-planar interface used in PDC cutters.
Figure 5:
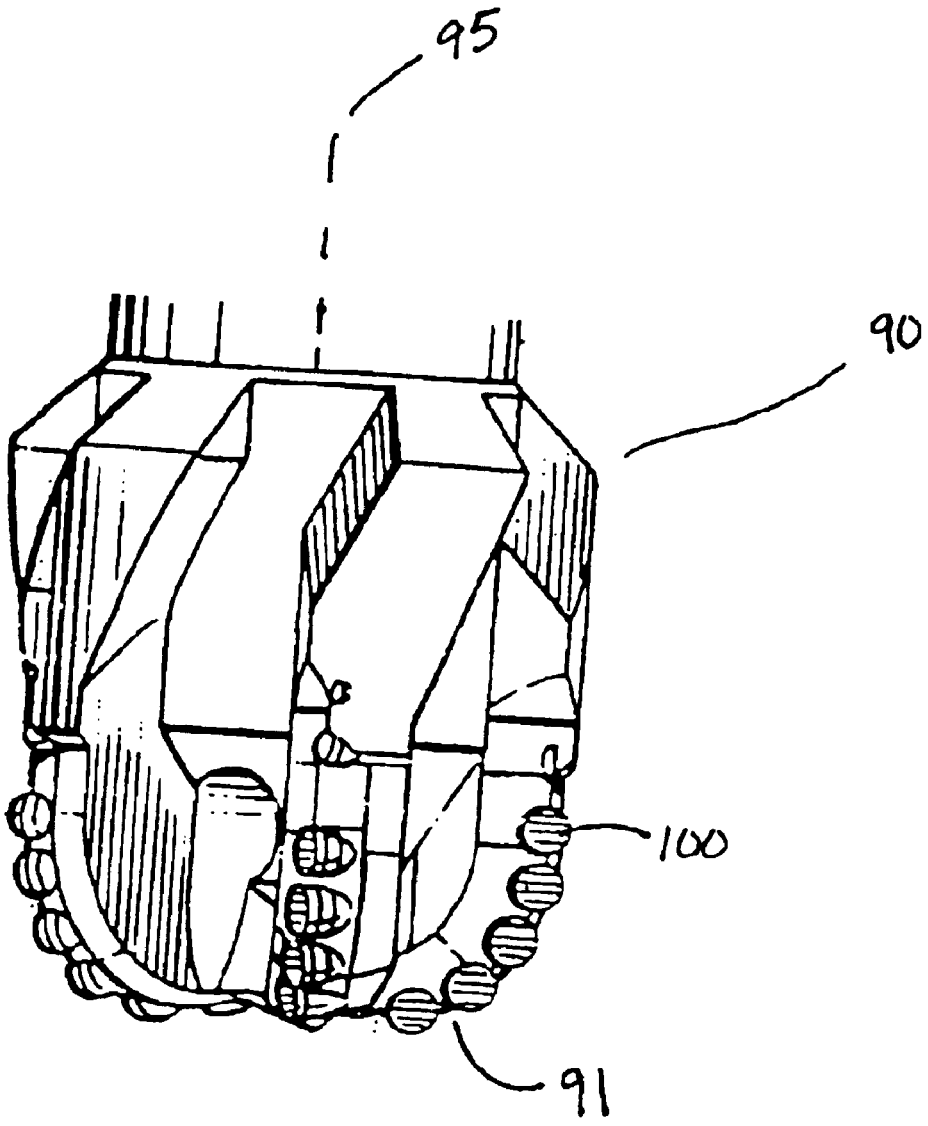
FIG. 5 illustrates one embodiment of a drill bit using a PDC cutter in accordance with the claimed invention.

FIG. 5 illustrates one embodiment of a drill bit in accordance with the present invention. In other embodiments, any type of drill bit may be used, as long as at least one PDC cutter is implemented with the drill bit. Thus, FIG. 5 is intended only as a specific embodiment of the invention and should in no way limit the scope of the claimed invention.

It has been determined that PDC cutters having diameters greater than 19.0 mm may be used on a drill bit without substantially increasing the failure rate of the cutters. In FIG. 5, a drill bit 90 having at least one PDC cutter 100 is depicted. The drill bit 90 is formed with at least one blade 91, which extends generally outwardly away from a central longitudinal axis 95 of the drill bit 90. The at least one PDC cutter 100 is disposed on the at least one blade 91. The number of blades 91 and/or cutters 100 is related to the type of rock to be drilled, and can thus be varied to meet particular rock drilling requirements. The at least one PDC cutter 100 in the present example is formed of a sintered tungsten carbide composite substrate (not shown separately in FIG. 5), and a polycrystalline diamond compact (not shown separately in FIG. 5). The polycrystalline diamond compact and the sintered tungsten carbide substrate may be bonded together using any method known in the art for such bonding.

Figure 6:
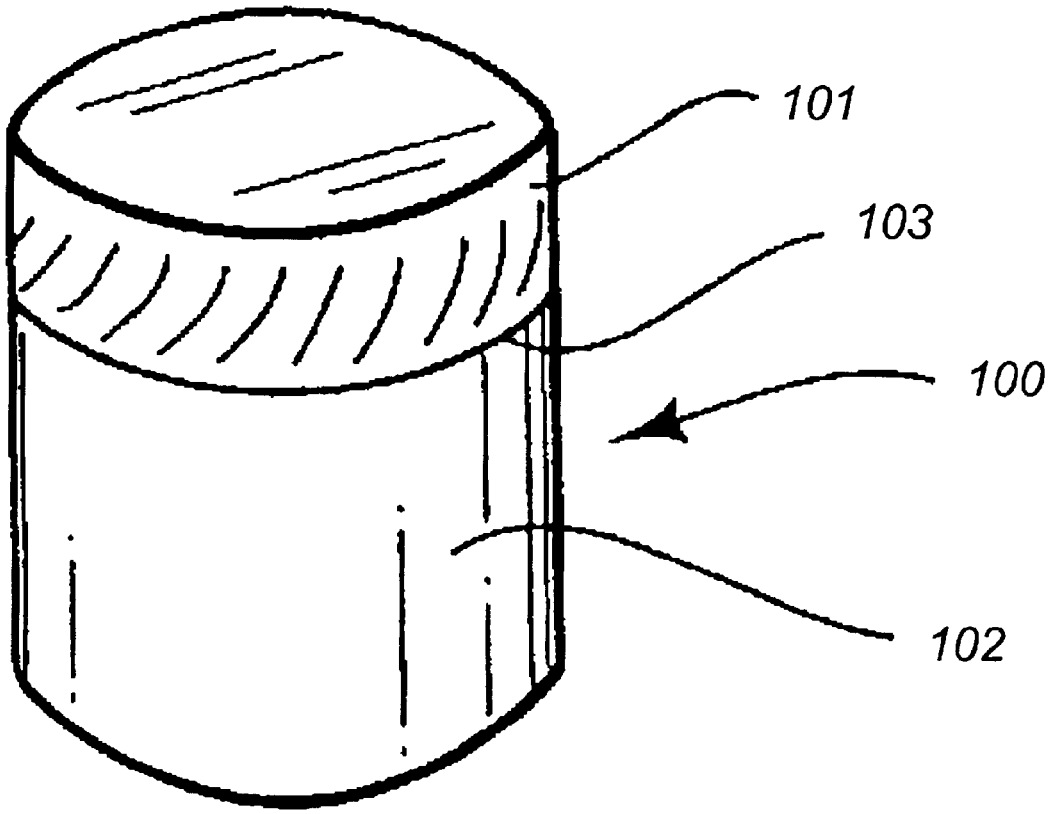
FIG. 6 illustrates one embodiment of a PDC cutter in accordance with the claimed invention.

In the present example, the at least one blade 91 has at least one socket or mounting pad (not shown separately), which is adapted to receive the at least one PDC cutter 100. In the present embodiment, the at least one PDC cutter 100 is brazed onto the at least one socket. It should be noted that the present invention relates to the structure of the PDC cutters, and no limitations should be imported from the description of the drill bits, blades, or methods of attaching these elements together. Further, references to the use of specific substrate compositions are for illustrative purposes only, and no limitation on the type of substrate used is intended. As an example, it is well known that various metal carbide compositions, in addition to tungsten carbide, may be used. In FIG. 6, the at least one PDC cutter 100 may have a diameter (not shown) greater than 19.0 mm. In some embodiments, where the interface 103 between the diamond table 101 and the substrate 102 is planar, preferably the diameter of the at least one cutter 100 is greater than 19.0 mm and is less than 25.0 mm. The cutter 100 diameter is more preferably in a range of between 21.0 mm and 23.0 mm. In the present example, the diameter of the cutter 100 is most preferably 22.0 mm.

Because the at least one PDC cutter 100 in this embodiment has a diameter of 22.0 mm and, thus, has a larger brazeable surface area, as compared to prior art cutters, a diamond table thickness (not shown) of at least 0.140 inches can be used, without increasing stress related failure of the PDC cutter 100. In some embodiments, the diamond table thickness is in a range of about 0.140 to 0.240 inches. In the present embodiment, the diamond table thickness is most preferably about 0.180 inches.

Additionally, the exposure of the at least one PDC cutter 100, which is defined as the portion of the PDC cutter diameter 100 extending beyond the at least one blade 91, in the present embodiment is greater than 11.0 mm. This limitation applies specifically to cylindrical cutters having a round or an elliptical cross section formed in accordance with the present invention. It is well known in the art that a type of PDC cutter known as a "stud cutter" can have much larger exposure. Prior art cylindrical cutters having round or elliptical cross sections have exposures of less than 10.0 mm by comparison.

Figure 7:
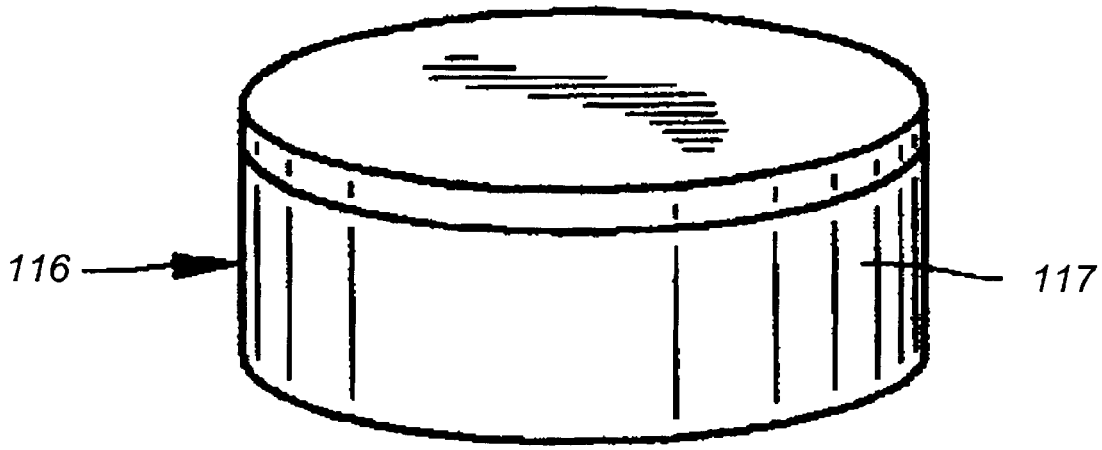
FIG. 7 illustrates one embodiment of a PDC cutter in accordance with the claimed invention.

A second embodiment of the present invention, shown in FIG. 7, includes PDC cutters having a substantially elliptical cross-section substrate 117 with a major axis diameter of greater than 19.0 mm and less than 25.0 mm, rather than a substantially circular cross section in the PDC cutters described above. The following description relates only to the PDC cutters themselves, but it should be understood that at least one of such cutters is included on a drill bit as described in the previous embodiments. More preferably, the elliptical cross-section cutter 116 has a major axis diameter of between 21.0 and 23.0 mm. Most preferably, the elliptical PDC cutter has a major axis diameter of 22.0 mm. Similar to the above embodiment, using a larger diameter elliptical PDC cutter allows more diamond to be deposited onto the surface of the substrate resulting in a diamond table thickness that is preferably in a range of 0.140 inches to 0.200 inches. In addition, the exposure of the PDC cutter in some embodiments may be increased to more than 11.0 mm.

The foregoing description of substantially elliptical cross-section PDC cutters is intended to include within its scope any number of shapes which include a longest diametric dimension and a shortest diametric dimension. Accordingly, the shape of any PDC cutter according to the invention is not intended to be limited to perfect ellipse cross-section or perfect circle cross-section.

In another embodiment, a drill bit having a PDC cutter according to the present invention may have a non-planar interface between the substrate and the diamond layer thereon. One example of such a non-planar interface is described, for example, in U.S. Pat. No. 5,662,720, wherein an "egg-carton" shape is formed into the substrate by a suitable cutting and etching process. The substrate surface may be, for example, a sintered metal-carbide, such as tungsten carbide as in the previous embodiments. Similarly to the above described embodiments, a diamond layer is then deposited onto the substrate. The diameter of the cutter thus formed according to this aspect of the invention is greater than 19.0 mm. The diameter range is more preferably between 21.0 mm and 23.0 mm, and most preferably 22.0 mm. The resulting PDC cutter may have a diamond table thickness of between 0.140 inches and 0.240 inches without significantly increasing the failure rate of the cutter thus formed. A more preferable thickness is about 0.180 inches. Other non-planar interfaces may be also used, for example, the interface described in U.S. Pat. No. 5,494,477.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit comprising:

a bit body having at least one blade thereon;

at least one polycrystalline diamond compact cutting element disposed on the at least one blade, wherein a diameter of the at least one polycrystalline diamond compact cutting element is within a range of greater than 20.0 mm, but less than 25.0 mm, wherein the at least one polycrystalline diamond compact cutting element comprises a substrate and a polycrystalline diamond layer thereon, and an interface between the substrate and the diamond layer being non-planar; and wherein the polycrystalline diamond layer has a thickness between 0.140 inches and 0.240 inches.

2. The drill bit of claim 1, wherein the polycrystalline diamond layer has a thickness of 0.180 inches.

3. The drill bit of claim 1, wherein the diameter of the at least one polycrystalline diamond compact cutting element is within a range of about 21.0 mm to 23.0 mm.

4. The drill bit of claim 2, wherein the diameter of the at least one polycrystalline diamond compact cutting element is 22.0 mm.

5. The drill bit of claim 1, wherein the at least one polycrystalline diamond compact cutting element has a substantially elliptical shape and the diameter of the at least one polycrystalline diamond compact cutting element is defined with respect to a major axis thereof.

6. The drill bit of claim 5, wherein the at least one polycrystalline diamond compact cutting element has a major axis having a diameter of 22.0 mm.

7. The drill bit of claim 1, wherein an exposure of the at least one polycrystalline diamond compact cutting element is greater than 11.0 mm.

8. A drill bit comprising:

a bit body having at least one blade thereon; and at least one polycrystalline diamond compact cutting element disposed on the at least one blade, the at least one polycrystalline diamond compact comprising:

a polycrystalline diamond layer;

substrate bonded to the polycrystalline diamond layer, an interface surface between the diamond layer and the substrate being non-planar;

wherein a diameter of the at least one polycrystalline diamond compact cutting element is greater than 20.0 mm and wherein the polycrystalline diamond layer has a thickness between 0.140 inches and 0.240 inches.

9. The drill bit of claim 8, wherein the polycrystalline diamond layer has a thickness of about 0.180 inches.

10. The drill bit of claim 8, wherein the diameter of the at least one polycrystalline diamond compact cutting element is within a range of about 21.0 mm to 23.0 mm.

11. The drill bit of claim 10, wherein the diameter of the at least one polycrystalline diamond compact cutting element is 22.0 mm.

12. The drill bit of claim 8, wherein the at least one polycrystalline diamond compact cutting element has a substantially elliptical shape and the diameter of the cutting element is defined with respect to a major axis thereof.

13. The drill bit of claim 12, wherein the at least one polycrystalline diamond compact cutting element has a major axis having a diameter of 22.0 mm.

14. The drill bit of claim 8, wherein an exposure is greater than 11.0 mm.

15. A drill bit comprising:

a bit body having at least one blade thereon; and at least one polycrystalline diamond compact cutting element disposed on the at least one blade, the at least one polycrystalline diamond compact comprising:

a substrate bonded to the polycrystalline diamond layer, an interface surface between the substrate and the diamond layer being non-planar;

wherein a diameter of the at least one polycrystalline diamond compact cutting element is greater than 20.0 mm and is less than 25.0 mm; and wherein the polycrystalline diamond layer has a thickness of between 0.140 inches and 0.240 inches.

16. The drill bit of claim 15, wherein the polycrystalline diamond layer has a thickness of about 0.180 inches.

17. The drill bit of claim 15, wherein the diameter of the at least one polycrystalline diamond compact cutting element falls within a range of 21.0 mm to 23.0 mm.

18. The drill bit of claim 17, wherein the diameter of the at least one polycrystalline diamond compact cutting element is 22.0 mm.

19. The drill bit of claim 15, wherein the at least one polycrystalline diamond compact cutting element has a substantially elliptical shape and the diameter of the cutting element is defined with respect to a major axis thereof.

20. The drill bit of claim 19, wherein the at least one polycrystalline diamond compact cutting element has a major axis having a diameter of 22.0 mm.

21. The drill bit of claim 15, wherein the exposure is greater than 11.0 mm.

22. A drill bit comprising:

a bit body having at least one blade thereon; and at least one polycrystalline diamond cutting element disposed on the at least one blade, the at least one polycrystalline diamond cutting element having an exposure greater than 11mm, the at least one polycrystalline diamond cutting element comprising:

a polycrystalline diamond layer having a thickness of greater than 0.140 inches;

a substrate bonded to the polycrystalline diamond layer, an interface surface between the diamond layer and the substrate being non-planar; and wherein a diameter of the at least one polycrystalline diamond compact cutting element is 22.0 mm.

23. A drill bit comprising:

a bit body having at least one blade thereon; and at least one polycrystalline diamond compact cutting element disposed on the at least one blade, wherein a diameter of the at least one polycrystalline diamond compact cutting element is within a range of greater than 19.0 mm, but less than 25.0 mm, and a polycrystalline diamond layer of the at least one polycrystalline diamond compact cutting element has a thickness between 0.160 inches and 0.240 inches, wherein the at least one polycrystalline diamond compact cutting element comprises a substrate and a polycrystalline diamond layer thereon, and an interface between the substrate and the diamond layer being non-planar.

* * * * *